US007066331B2

(12) United States Patent
Koyanagi et al.

(10) Patent No.: US 7,066,331 B2
(45) Date of Patent: Jun. 27, 2006

(54) CUBIC CUSHIONING MATERIAL AND PRODUCTION METHOD THEREOF

(75) Inventors: Yoshihiro Koyanagi, Kashiwara (JP); Yoshihumi Koyanagi, Kashiwara (JP)

(73) Assignee: Kabushiki Kaisha Kashiwara Seitai, Osaka (JP)

( * ) Notice: Subject to any disclaimer, the term of this patent is extended or adjusted under 35 U.S.C. 154(b) by 0 days.

(21) Appl. No.: 10/250,366

(22) PCT Filed: Nov. 22, 2002

(86) PCT No.: PCT/JP02/12218

§ 371 (c)(1),
(2), (4) Date: Jul. 1, 2003

(87) PCT Pub. No.: WO03/099678

PCT Pub. Date: Dec. 4, 2003

(65) Prior Publication Data

US 2004/0163991 A1 Aug. 26, 2004

(30) Foreign Application Priority Data

May 28, 2002 (JP) ..... 2002-153867

(51) Int. Cl.
*B65D 81/02* (2006.01)

(52) U.S. Cl. ..... 206/522; 383/3

(58) Field of Classification Search ..... 206/522, 206/591, 594, 521; 383/3; 428/69, 172
See application file for complete search history.

(56) References Cited

U.S. PATENT DOCUMENTS

| | | | | |
|---|---|---|---|---|
| 4,091,852 | A * | 5/1978 | Jordan et al. | 383/3 |
| 4,551,379 | A * | 11/1985 | Kerr | 428/200 |
| 5,217,131 | A * | 6/1993 | Andrews | 220/1.5 |
| 5,263,587 | A * | 11/1993 | Elkin et al. | 206/522 |
| 5,769,231 | A * | 6/1998 | Batsford | 206/522 |
| 6,513,974 | B1 * | 2/2003 | Malone et al. | 383/3 |
| 6,629,777 | B1 * | 10/2003 | Tanaka et al. | 383/3 |

FOREIGN PATENT DOCUMENTS

| | | |
|---|---|---|
| JP | 31-12673 | 8/1956 |
| JP | 4-78170 U | 7/1992 |
| JP | 9-86565 A | 3/1997 |
| JP | 2001-514605 A | 9/2001 |
| JP | 2001-335073 A | 12/2001 |

* cited by examiner

*Primary Examiner*—David T. Fidei
(74) *Attorney, Agent, or Firm*—Birch, Stewart, Kolasch & Birch, LLP

(57) ABSTRACT

A cubiform cushioning medium 4 comprises a planar cushioning medium 1 with a plurality of cells 12 formed by partially bonding non-breathable flexible resin sheets and the cells 12 which air is encapsulated thereinside, and the planar cushioning medium 1 is folded and bonded partially to complete an opening A to be protected for containing. The cubiform cushioning medium 4 thus has lateral cushioning faces 31, 34 disposed at the side of the opening 42 and an bottom cushioning portion 35 disposed at the bottom of the opening 42 by bending the planar cushioning medium 1 at the bottom end of the lateral cushioning mediums 31, 34 so that the end cushioning medium 35 is folded upward to the top of the lateral cushioning mediums 31, 34.

14 Claims, 9 Drawing Sheets

CUBIC CUSHIONING MATERIAL AND PRODUCTION METHOD THEREOF

FIELD OF THE INVENTION

The present invention relates to a cubiform cushioning medium for containing articles to be protected such as bottles or electric appliances, while securing the article from damage.

DESCRIPTION OF BACKGROUND ART

Air-inflated cushioning mediums having an air-encapsulating portion formed between overlying resin sheets have been widely used so far. They may protect articles to be protected against impact from outside by forming an air-inflated portion partially or entirely around the article.

An air-inflated cushioning medium has been proposed, for example, by Japanese Utility Model Application Laid Open No. H06-35973. This proposes a cubiform cushioning medium comprising an opening for containing an article to be protected, which can be produced by steps of sealing airtight plastic films together for separate air-encapsulating cells and then forming said plastic films into a shape like an envelope.

In the bottom part of this cubiform cushioning medium, the above-mentioned cells are arranged to communicate with each other so that air in the cells may flow therebetween.

However, when the opening of the medium contains something damageable such as bottles or a relatively heavy article like electric appliances, said cubiform cushioning medium is incapable of absorbing any impact in case of dropping or other manners only with the air-contained cells, resulting in breaking the article by way of burst of the cells and airflow therein to cause direct impact against said article.

In view of the above-described problems, a first object of the present invention is to provide a cubiform cushioning medium which puts weight on protection around the bottom portion in particular, and is capable of protecting a damageable article like a bottle sufficiently.

Furthermore, a second object of the present invention is to provide a cubiform cushioning medium capable of protecting a relatively heavy article sufficiently.

DISCLOSURE OF THE INVENTION

To solve said problems a first aspect of the present invention provides a cubiform cushioning medium comprising a planar cushioning medium 1 with a plurality of cells 12 formed by partially sealing opposite non-breathable flexible resin sheets together, said cells 12 acting to cause cushioning effect by means of air encapsulated thereinside, lateral cushioning faces 31, 34/61, 65 and bottom cushioning portions 35/66 disposed by folding said planar cushioning medium 1, wherein the lateral cushioning faces 31, 34/61, 65 and the bottom cushioning portions 35/66 define an opening 42 for containing an article A to be protected by bonding the overlapped ends thereof, wherein the bottom cushioning portions 35/66 are folded upward to the top of the lateral cushioning faces 31, 34/61, 65.

It will be noticed that the above-mentioned terms such as "upward" are intended to specify the relative positional relations but not absolute one, which may also apply in the following. In accordance with this aspect of the present invention, the bottom cushioning portions 35/66 are folded upward to the top of the lateral cushioning faces 31, 34/61, 65, whereby cushioning effect at the bottom along with the bottom cushioning portions 35/66 may be more effective than conventional cushioning mediums achieved only by air inside the cells so as to protect the article A.

A second aspect of the present invention, as defined in said first aspect of the present invention, provides the cubiform cushioning medium, wherein the lateral cushioning faces 31, 34 are formed at the lateral side of the opening 42 so as to face opposite, and the bottom cushioning portion 35 is arranged to connect the bottom end of the lateral cushioning faces 31, 34, and be folded along crease seals 22 formed thereon.

In accordance with this aspect of the present invention, in addition to said effect, the bottom cushioning portion as folded along the crease seals may protect the article effectively.

A third aspect of the present invention, as defined in said first aspect of the present invention, provides the cubiform cushioning medium, wherein the lateral cushioning faces 61, 65 are formed at the lateral side of the opening 42 so as to face opposite and the bottom cushioning portion 66 is arranged to close the bottom end of the lateral cushioning faces 61, 65, and part of the portion 66 is folded along the lateral cushioning faces 61, 65, and the folded part of the bottom cushioning portion 66 and the lateral cushioning faces 61, 65 are bonded together to form crease seals 52, 53 at desired length above from the bottom end of the lateral cushioning faces 61, 65.

In accordance with this aspect of the present invention, in addition to the effect of the first aspect of the present invention, the cushioning effect produced by the overlapped portion of the bottom cushioning portion 66 and the lateral cushioning faces 61, 65 which are partially bonded together may protect the article A effectively.

A fourth aspect of the present invention, as defined in the second or third aspect of the present invention, provides the cubiform cushioning medium, wherein the respective right and left sides 1*c*, 1*d* of the opposite lateral cushioning faces 31, 34/61, 65 are arranged and bonded together so as to encircle the opening 42.

In accordance with this aspect of the present invention, in addition to the effect of said second or third aspect of the present invention, the arrangement of the lateral cushioning faces 31, 34/61, 65 in a manner of encircling the opening 42 may protect an article A in the 360-degree directions.

A fifth aspect of the present invention, as defined in any one of the second to fourth aspects of the present invention, provides the cubiform cushioning medium, wherein the cells 12, strip-like elements formed in a vertical direction, are respectively provided with an air inlet 12*a* for introducing air into each of the cells 12, and said crease seals 22/52, 53 are formed by partially sealing the cells so as to allow air to flow in the cells 12.

In accordance with this aspect of the present invention, in addition to the effects of the second to fourth aspects of the present invention, inasmuch as the air inlet 12*a* is formed in each of the cells 12, one deflated cell will not affect other cells 12, so that the cushioning effect may be preserved. Furthermore, partially sealed crease seals 22/52, 53 allow air to flow in the cells 12 freely, and determine the configuration of the bottom cushioning faces 35/66.

A sixth aspect of the present invention provides a production process for a cubiform cushioning medium comprising a planar cushioning mediums 1 with a plurality of cells 12 formed by partially sealing opposite non-breathable flexible resin sheets together, said cells 12 acting to cause cushioning effect by means of air encapsulated thereinside; wherein it comprises steps of partitioning said planar cushioning medium 1 partitioned into a first face 31, a second face 32, a third face 33, and a fourth face 34, all the faces lying vertically adjacent to each other, and folding the faces 31 to 34 along lines 21 to 23 to place the first and fourth faces 31, 34 in an opposite position, and tucking the second and third faces 32, 33 between the first and fourth faces 31, 34, and bonding the overlapped end of the respective left and right sides 1*c*, 1*d* together in order to complete an opening 42 for containing an article A to be protected, thus being surrounded by the faces 31 to 34.

In accordance with this aspect of the present invention, uncomplicated forming of a cubiform cushioning medium 4 may be provided by folding a planar cushioning medium 1 and the cubiform cushioning medium 4 may provide superior cushioning effect compared to conventional cushioning mediums.

A seventh aspect of the present invention provides a production process for a cubiform cushioning medium comprising a planar cushioning mediums 1 with a plurality of cells 12 formed by partially sealing opposite non-breathable flexible resin sheets together, said cells 12 acting to cause cushioning effect by means of air encapsulated thereinside; wherein it comprises steps of partitioning the planar cushioning medium 1 into a first face 61, a second face 62, a third face 63, a fourth face 64, and a fifth face 65, all the faces lying vertically adjacent to each other, and folding said faces 61 to 65 along lines 51 to 54 to place the first and fifth faces 61, 65 in an opposite position, and contacting the first face 61 to the second face 62 and the fourth face 64 to the fifth face 65, and bonding the overlapped end of the respective left and right sides 1*c*, 1*d* together in order to complete an opening 42 for containing an article A to be protected, thus being encircled by the faces 61 to 65.

In accordance with this aspect of the present invention, uncomplicated forming of the cubiform cushioning medium 4 may be provided by folding a planar cushioning medium 1 and the cubiform cushioning medium 4 may provide superior cushioning effect compared to conventional cushioning mediums.

BEST MODE TO PRACTICE

Figure 1:
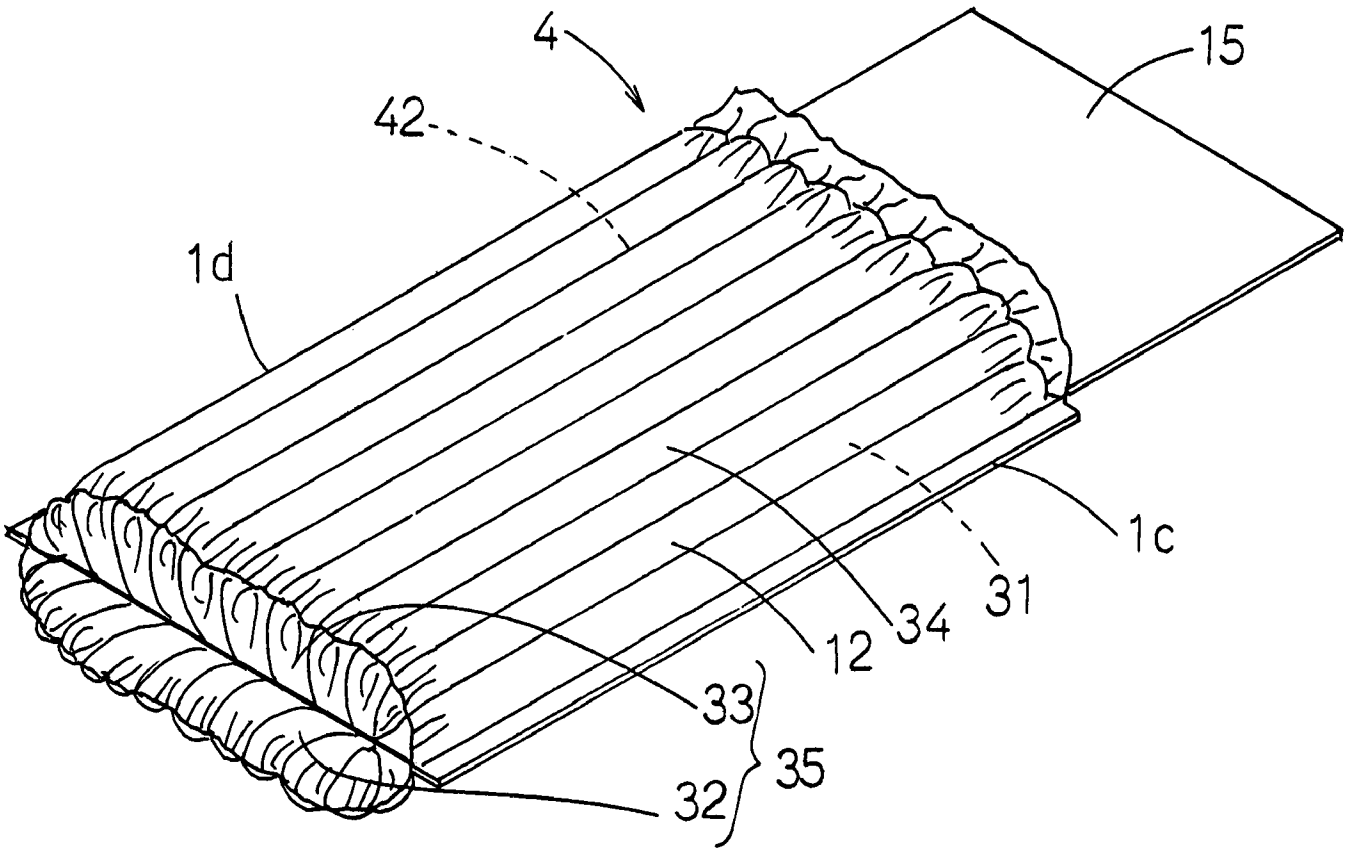
FIG. 1 is a perspective view representing a cubiform cushioning medium in accordance with a first embodiment of the present invention.

Embodiments of the cubiform cushioning medium according to this invention will be described hereinafter with reference to the accompanying drawings.

The first embodiment will be described.

As a material of cubiform cushioning mediums 4 in accordance with the present invention, non-breathable flexible resin sheet of polyethylene or the like is used to make a planar cushioning medium 1. In this embodiment are used two substantially rectangular polyethylene sheets having an upper short side 1*a*, a lower short side 1*b*, and a left long side 1*c* and a right long side 1*d* positioned perpendicular to the short sides 1*a*, 1*b* respectively (see FIG. 2). A plurality of independent cells 12 and an air introduction passage 13 communicating with each cells 12 are formed by seals 11 on the overlying sheets by means of hot press or the like so as to make a planar cushioning medium 1 shown in FIG. 2.

In this embodiment, not only use of two sheets for making a planar cushioning medium 1 as mentioned above, but a single sheet may be applied by folding it in two. Of course, other means may be employed for production of the planar cushioning medium 1.

In this embodiment, the cells 12 shape like a strip as formed to extend in parallel to the long sides 1*c*, 1*d* of the planar cushioning medium 1. Each cell 12 is opened at one end 12*a* and closed at the other end 12*b* thereof. The air introduction passage 13 perpendicular to the cells 12 is formed to communicate with each of the opened ends 12*a* via check valves 14. The air introduction passage 13 is opened at one end 13*a* and closed at the other end 13*b* thereof. The opened end 13*a* serves as an inlet for introduction of air.

Thus, the cells 12 are formed adjacent to the air introduction passage 13 diverging from one side thereof in a single direction, so that the cells 12 can be inflated by introducing air from the opened end 13*a* of the air introduction 13.

Another arrangement may be applied such that air can be introduced directly into the cells 12 without an air introduction passage.

In the present embodiment, a check valve 14 is provided at each of the opened ends 12*a* where the air introduction passage 13 connects with each cell 12. Briefly speaking, the check valves 14, which are composed by a segment of flexible resin sheet, act to allow air to flow from the air introduction passage 13 into the cells 12 while preventing a reverse airflow, whereby inflation of the cells 12 may be maintained.

As a check valve 14 is provided in each cells 12, air leakage is limited to a damaged cell, so the other cells are not affected by such leakage, maintaining cushioning effect as a whole.

The arrangement of the check valves 14 is not restricted to that as mentioned. A single check valve may be provided at the opened end 13*a* of the air introduction passage 13, or alternatively, no check valve has to be used when air is introduced into the cells 12 before the opened ends 12*a* of the cells 12 or the opened end 13*a* of the air introduction passage 13 are closed by means of hot press or the like, whereby the air in the cells may be maintained.

A cover 15, which is not inflated by air, may be added when necessary. This portion will act to cover an opening portion 41 after the cubiform cushioning medium 4 is completed.

The planar cushioning medium 1 may be configured such that occasional inflation or deflation at selected cells 12 can be achieved by providing a check valve or fastener for opening and closing means therein to control the cells from the outside. In this manner, only selected cells 12 may be inflate or deflated after use of the cubiform cushioning medium 4, and may be reused by the introduction of air thereinside.

Additionally, with a notch provided at the long sides 1*c*, 1*d* of the planar cushioning medium 1, when the cubiform cushioning medium 4 is disposed, the cells 12 are torn apart from the notch. Or the cells 12 are provided with windows for letting air out easily so that the cells 12 may be readily lessened in volume by letting air out.

As aforementioned, the cells 12 may be varied in configuration in different manners.

Figure 2:
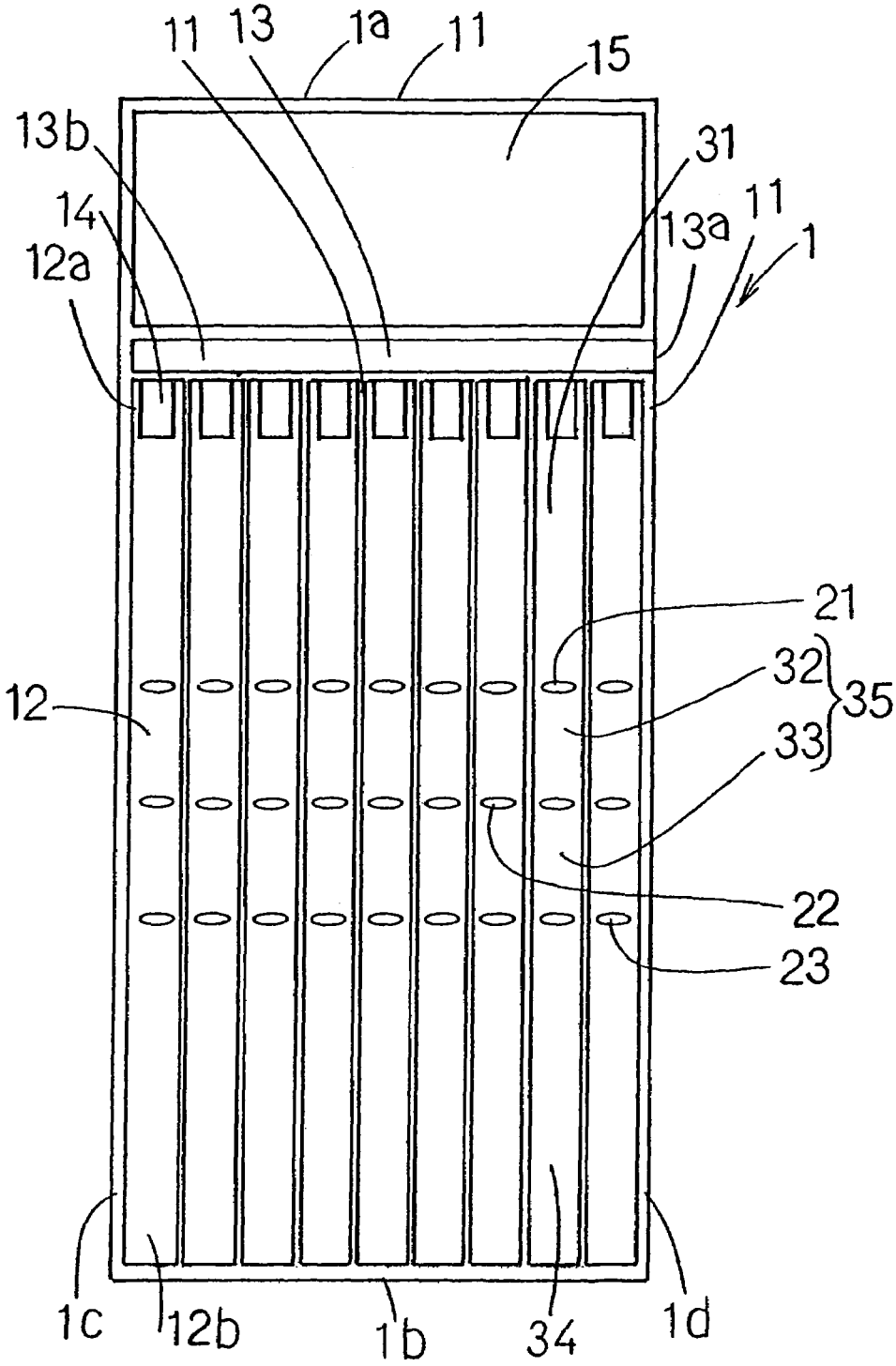
FIG. 2 is a view representing a forming process for cubiform cushioning medium in accordance with the first embodiment of the present invention, and a plan view representing a planar cushioning medium.

Next, folding of the planar cushioning medium 1 as formed with cells 12 shown in FIG. 2, is described.

The planar cushioning medium 1 having cells 12 and an air introduction passage 13 is folded along crease lines 21 to 23, and the overlapped end of the respective long sides 1*c*, 1*d* is bonded together.

The crease lines 21 to 23 are formed perpendicular to the cells 12 in this embodiment. A first crease line 21 is formed between a first face 31 and second face 32, a second crease line 22 between a second face 32 and third face 33, a third crease line 23 between a third face 33 and fourth face 34, respectively.

Figure 3:
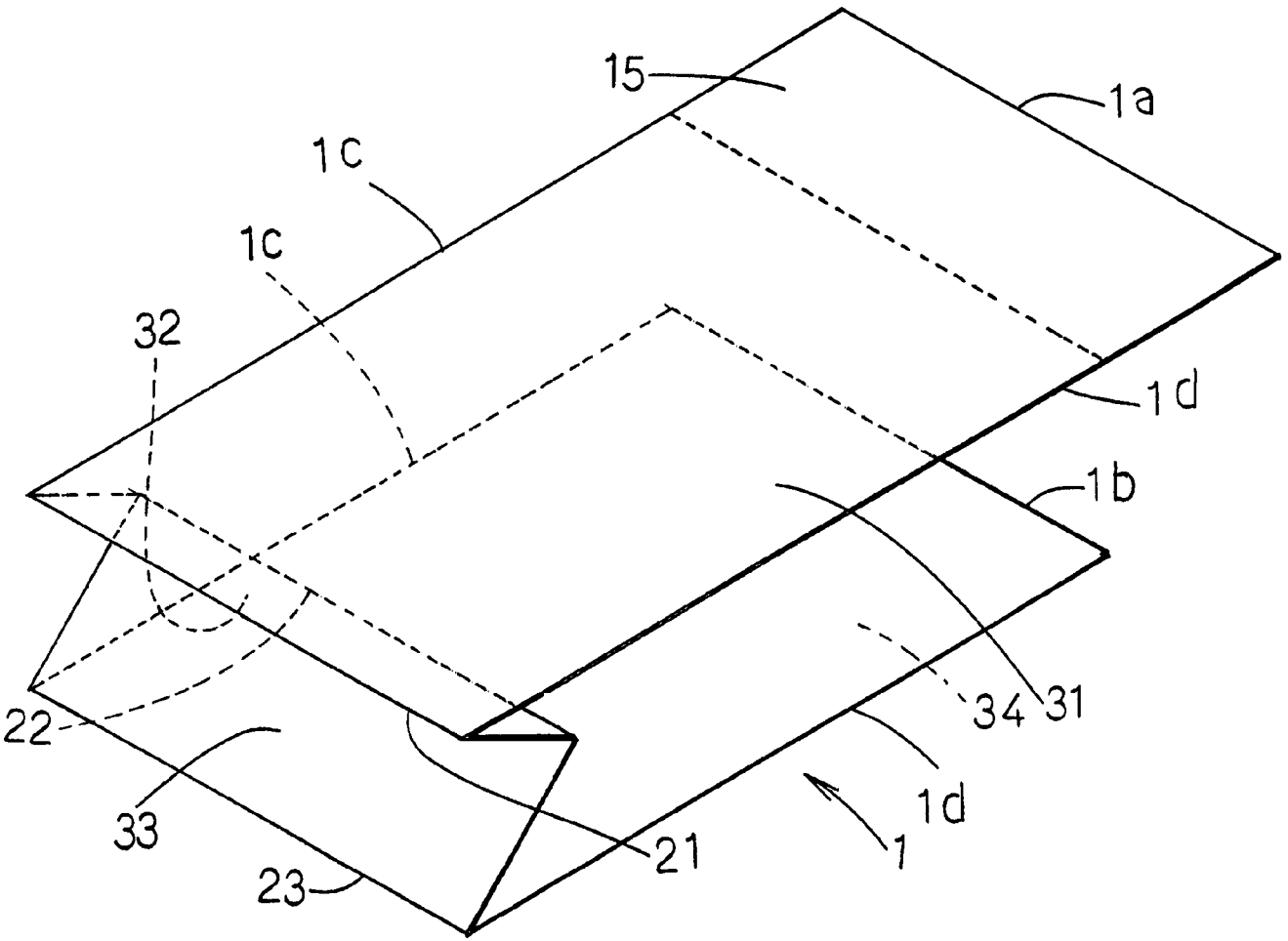
FIG. 3 is a view showing the forming process for cubiform cushioning medium in accordance with the first embodiment of the present invention, and a schematic perspective view representing the state of a folded planar cushioning medium.

The planar cushioning medium 1 is folded as mountain fold along the first crease line 21 and third crease line 23 and folded as valley fold along the second crease line 22, which is positioned exactly medial from the first and third crease lines 21, 23 in this embodiment. Hence, as shown in FIG. 3, the first and fourth faces 31, 34 face opposite, and the second and third faces 32, 33 are tucked between the first and fourth faces 31, 34. Accordingly, the planar cushioning medium 1 in cross portion is substantially arranged into the form of Σ. The second and third faces 32, 33 will become the bottom cushioning portion 35 after the completion as a cubiform cushioning medium 4. While being folded along the crease lines 21 to 23, the cushioning medium is kept opened along the long right and left sides thereof.

Variations may be applied to the positions and/or intervals relating to the crease lines 21 to 23 and the tucking of the second and third faces 32, 33 between the first and fourth faces 31, 34 for achieving desirable configurations of the bottom portion 35, which fits for an article A to be protected.

The overlapped end of the respective long sides 1*c*, 1*d* in the folded planar cushioning medium 1 is bonded together as one. Thus, the first and fourth faces 31, 34 may turn into lateral cushioning faces, thereby resulting in completing a cubiform cushioning medium 4 (before inflated), which is closed in the directions of right and left sides thereof.

Figure 4:
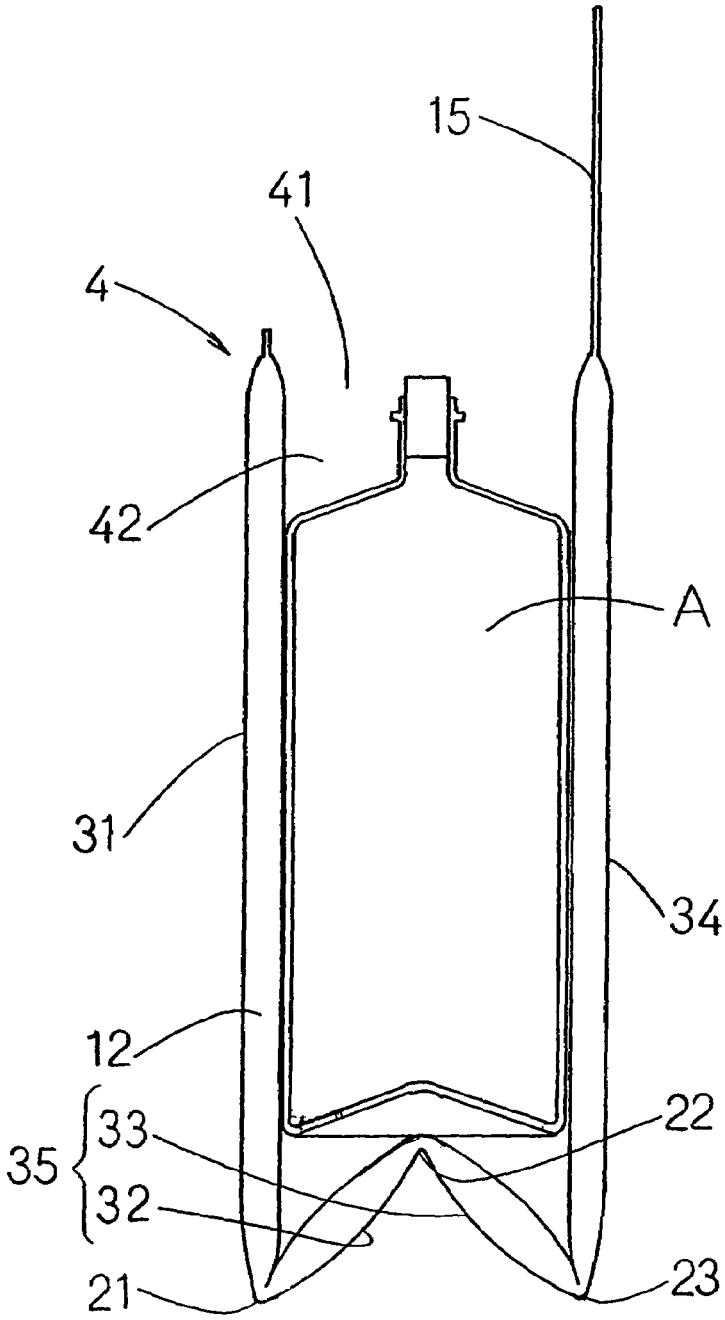
FIG. 4 is a cross sectional view representing the state of the cubiform cushioning medium in use in accordance with the first embodiment of the present invention.

The upper short side 1*a* and lower short side 1*b* which is opposite to the short side 1*a* in the cubiform cushioning medium 4 are not bonded. So a space between the first and fourth faces 31, 34 is left open. As shown in FIG. 4, this portion will provide an opening portion 41 for taking an article A to be protected in and out.

The cubiform cushioning medium 4 is completed as above-described, and the second crease line 22 in the bottom portion 35 is separate from the lateral cushioning faces 31, 34 other than both right and left ends thereof (at the long sides 1*c*, 1*d* in the planar cushioning medium 1).

Thus, when the cells 12 are inflated with air, two slopes from an edge line of the second crease line 22 to the bottom ends of the cushioning faces 31, 34 are defined by the second face 32 formed between the first and second crease lines 21, 22 and the third face 33 formed between the third and second crease lines 23, 22.

In accordance with the present embodiment, said crease lines 21 to 23 are formed like a dotted or short line as a result of partial sealing on the cells 12 by means of hot press. Because of a manner of partial sealing, the cells 12 communicate with each other through the crease lines 21 to 23 which neither act to block all the cells 12, nor to prevent a flow of air within the cells 12.

The first and third crease lines 21, 23 may be positioned without partial sealing, only to be folded. As shown in FIG. 4, the first and third crease lines 21, 23 are formed by partial sealing, resulting in the air being thin there, seemingly affecting the cushioning effect in these areas. Without partial sealing along the crease lines, the air along the lines is filled so that a higher cushioning effect may be expected compared with the status of partial sealing. However, a clear-cut bottom cushioning face will be achieved with partial sealing. In terms of design, it is favorable for the medium to have partial sealing. Therefore, most appropriate processing may be selected considering the nature of article A to be protected or the purpose of use.

Sealing along the crease lines 21 to 23 which completely close the cells 12 may be applied. In such a case, since the respective cells 12 become perfectly separate from each other by the crease lines 21 to 23, it is necessary to provide an air introduction passage 13 for each of the faces 31 to 34.

Next, an inflated cubiform cushioning medium 4 as illustrated in FIGS. 1 and 4 shall be produced by introducing air into the cells 12 of the cubiform cushioning medium 4 (before inflated) thus formed as set forth.

Introduction of air into the cells 12, for example, may be achieved by inserting a pipe or the like in the open end 13*a* of the air introduction passage 13. Air into the cells 12 passes through the air introduction passage 13 to reach the cells 12 via check valves 14. In this embodiment, each cells 12 is provided a check valve 14 respectively which serves to ensure preservation of the air after inflation of the cells 12. As mentioned above, partial sealing is provided along each of the crease lines 21 to 23 in the cells 12 so airflow through the lines is secured to inflate the cells 12 without difficulty.

In the present invention, check valves 14 are not essential. Without check valves 14, air leakage from the cells 12 can be prevented by subjecting the open end 13*a* of the air introduction passage 13 to hot press after the introduction of air or closing the open end 13*a* by a tap.

FIG. 4 shows the inflated first face 31 to the fourth face 34 by the air introduced into the cells 12. A space encircled by the faces 31 to 34 is an opening 42, in which an article A to be protected is received.

When the cubiform cushioning medium 4 is inflated, the second and third faces 32, 33 in the bottom cushioning portion 35 define two slopes having an edge line of the second crease line 22, so the bottom cushioning portion 35 is configured similarly to an inverted V against the opening 42.

The article A is supposed to contact the bottom cushioning portion 35 consisting of the second and third faces 32, 33 at the bottom of the cubiform cushioning medium. The bottom of the article to be protected contact the cells in the conventional cushioning mediums. In accordance with the present invention, however, the bottom cushioning portion 35 is folded upward or as mountain fold at the second crease line 22. When the bottom cushioning portion 35 of the cubiform cushioning medium 4 has an impact by falling or other incidents, the folded part along the second crease line 22 in the bottom cushioning portion 35 attempts to spread and absorb the impact in addition to cushioning effect of the cells 12, whereby more cushioning effect will be obtained.

Thus, damageable glass bottles such as for liquor are most suitable as the article A to be protected for this specific cubiform cushioning medium 4 usable as a packaging medium for effective protection.

The opening portion 41 can be closed by providing connecting means such as adhesive tapes or face fastener to the inside of the cover 15 in a manner that the connecting means is caught under the first face 31.

The configuration of the cubiform cushioning medium 4 is not restricted to that as exemplified in the above as the first embodiment but can be varied in different manners.

For example, for permitted variations, unlike the present embodiment, the lateral portions are furnished with planes, instead of curved surfaces, by using other methods of folding or bonding the sides of the planar cushioning medium 1 so that the cubiform cushioning medium 4 will have a square-built, or cylindrical or bottle-like configuration as a whole.

Referring to the cover 15, in the case of the cubiform cushioning medium 4 of the present embodiment, cells can be formed on the opposite side of said cells 12 so as to branch off from the air introduction passage 13, thereby allowing air to be sealed in the cells. With this arrangement, the cover 15 may possess its own cushioning effect as well.

Next, description will be made as reference to a second embodiment. In regard to a planar cushioning medium and cubiform cushioning medium, like reference characters indicate parts similar to those of said first embodiment.

The second embodiment is identical to the first embodiment in the main structure. Sheets made of non-breathable flexible resin as polyethylene or the like are used as materials to make a planar cushioning medium 1 as shown in FIG. 6.

Figure 6:
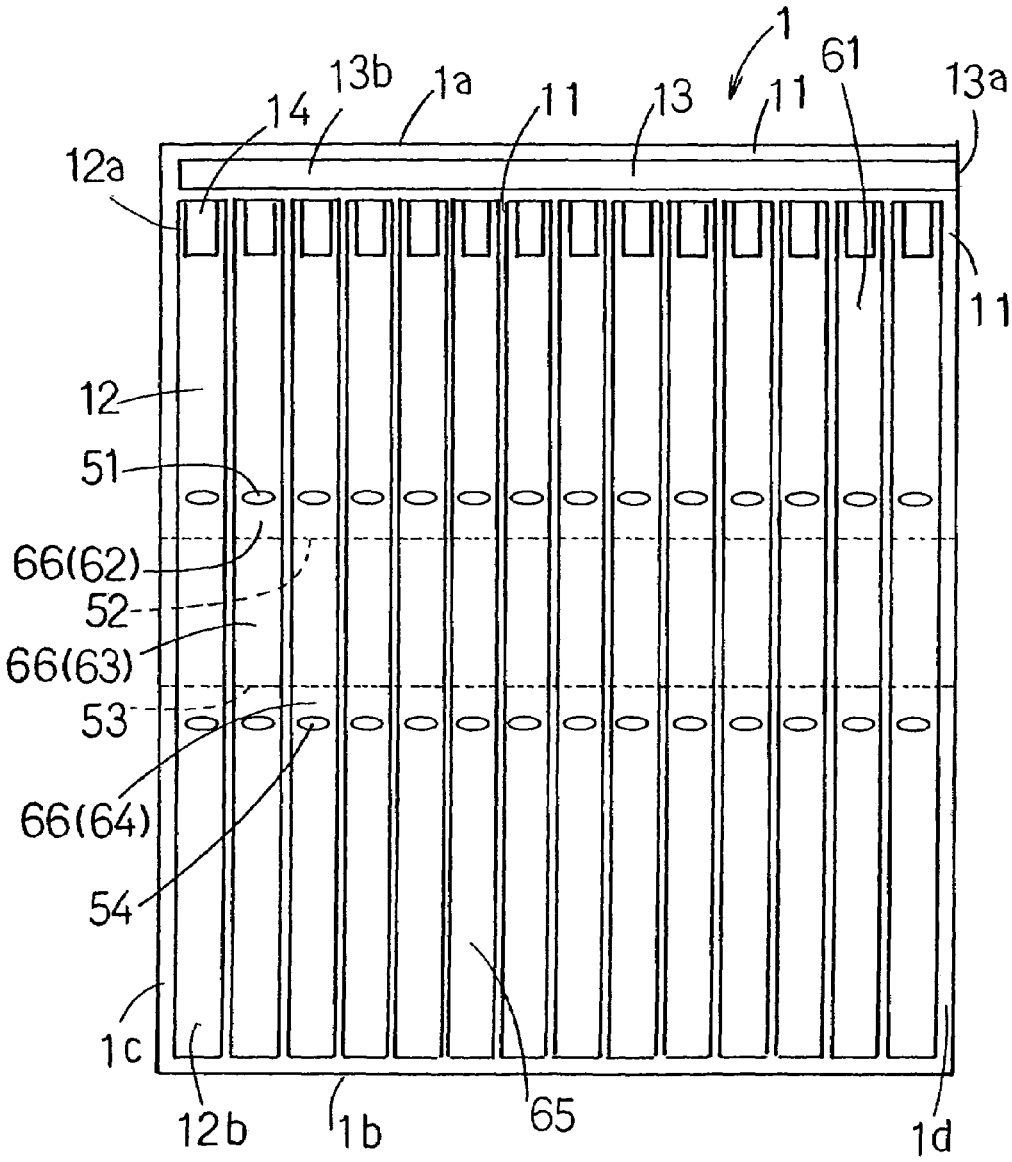
FIG. 6 is a view representing a forming process for cubiform cushioning medium in accordance with the second embodiment of the present invention, and a plan view representing a planar cushioning medium.

Folding of said planar cushioning medium 1 is almost same as the first embodiment as shown in FIG. 2, but the medium is folded along the crease lines 51 to 54 as shown in FIG. 6. The overlapped end of the respective long sides 1*c*, 1*d* is bonded together.

In this embodiment, the crease lines 51 to 54 are perpendicular to cells 12. The planar cushioning medium 1 of this embodiment is partitioned into first and second faces 61, 62 with a first crease line 51 interposed therebetween, second and third faces 62, 63 with a second crease line 52 interposed therebetween, third and fourth faces 63, 64 with a third crease line 53 interposed therebetween, and fourth and fifth faces 64, 65 with a fourth crease line 54 interposed therebetween respectively.

A mountain fold is done along the first crease line 51 and the fourth crease line 54 respectively. A valley fold is done along the second crease line 52 and the third crease line 53 respectively. Thus, after said folding, the second face 62 contacts the first face 61 and the fourth face 64 contacts the fifth face 65.

Figure 7:
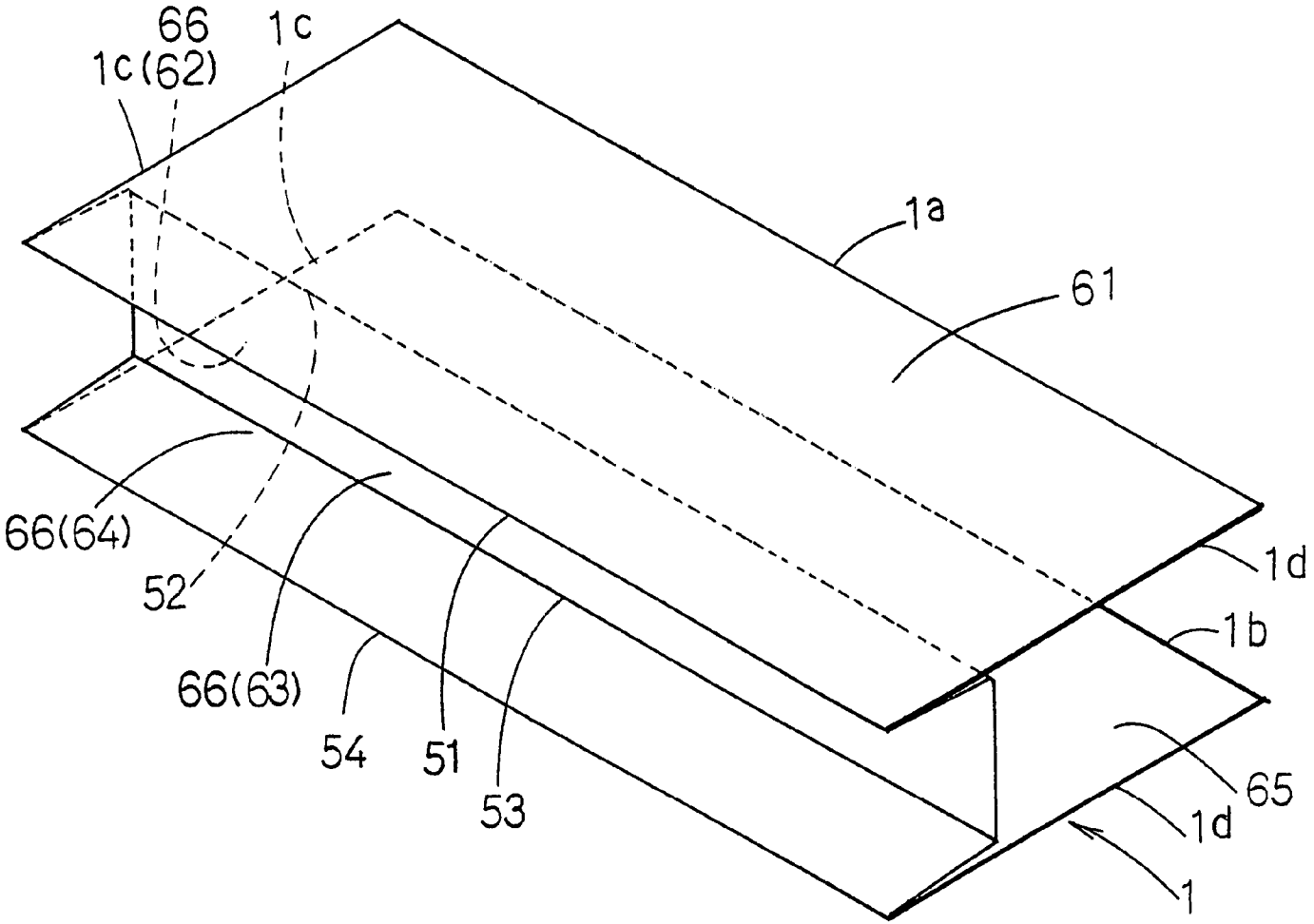
FIG. 7 is a view representing the forming process for the cubiform cushioning medium in accordance with the second embodiment of the present invention, and a schematic perspective view representing the state of a folded planar cushioning medium.

The first face 61 and fifth face 65, each being a lateral cushioning face of the planar cushioning medium 1 of the present embodiment, stay opposite each other, and the second, third and fourth faces 62, 63, 64, which represent a bottom cushioning portion 66, are formed between the first and fifth faces 61, 65, thereby resulting in the second and fourth faces 62, 64 lying opposed each other, so that the planar cushioning medium 1 will substantially have the form of an H in cross portion, as shown in FIG. 7.

When folded along the crease lines 51 to 54, the planar cushioning medium 1 is kept open along the right and left sides thereof.

Like the first embodiment, variations may be applied to the positions and/or internals relating to the crease lines 51 to 54, which, for example, define the interval of opposing faces of 61, 65 or a manner of the first and second faces 61, 62 and the fourth and fifth faces 64,65 for achieving desirable configurations of the bottom portion 66, where an article A to be protected contact.

Next, the first and second faces 61, 62 are bonded together by hot press or other sealing methods along the second crease line 52 and the fourth and fifth faces 64, 65 along the third crease line 53, respectively.

In this embodiment, like the first embodiment, the first and fourth crease lines 51, 54 which are sealed beforehand and the second and third crease lines 52, 53 which are bonded after said folding may have partial sealing in the cells 12 in dot or short line style. This partial sealing does not completely close the cells 12, so the cells communicate with each other through the crease lines 21 to 23 which do not prevent airflow.

As in the first embodiment, the first and fourth crease lines 51, 54 may be positioned without partial sealing, only to be folded.

In the above-mentioned folded planar cushioning medium 1, each of the long sides 1*c*, 1*d* are respectively bonded as one. Thus, the first and fifth faces 61, 65 may turn into cylindrical lateral cushioning faces, thereby resulting in completing a cubiform cushioning medium 4 (before inflated), which is closed in the directions of right and left sides thereof.

Figure 8:
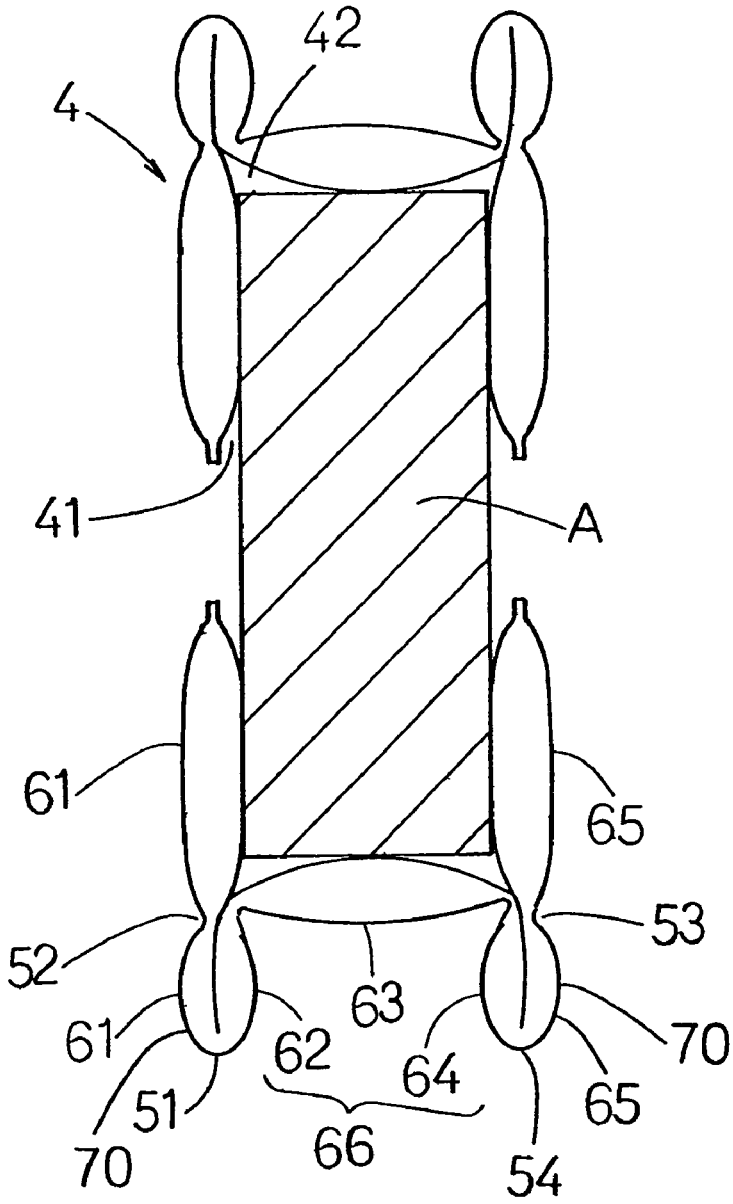
FIG. 8 is a cross sectional view representing the state of the cubiform cushioning medium in use in accordance with the second embodiment of the present invention.

The upper short side 1*a* and lower short side 1*b* which is opposite to the short side 1*a* in the cubiform cushioning medium 4 are not bonded. So, the area between the first and fifth faces 61, 65 is left open. As shown in FIG. 8, this portion will provide an opening portion 41 for taking an article A to be protected in and out.

In conformity to the use, the cubiform cushioning medium 4 may be left opened in the right and left directions along the long sides 1*c*, 1*d*, respectively not bonded together.

Figure 5:
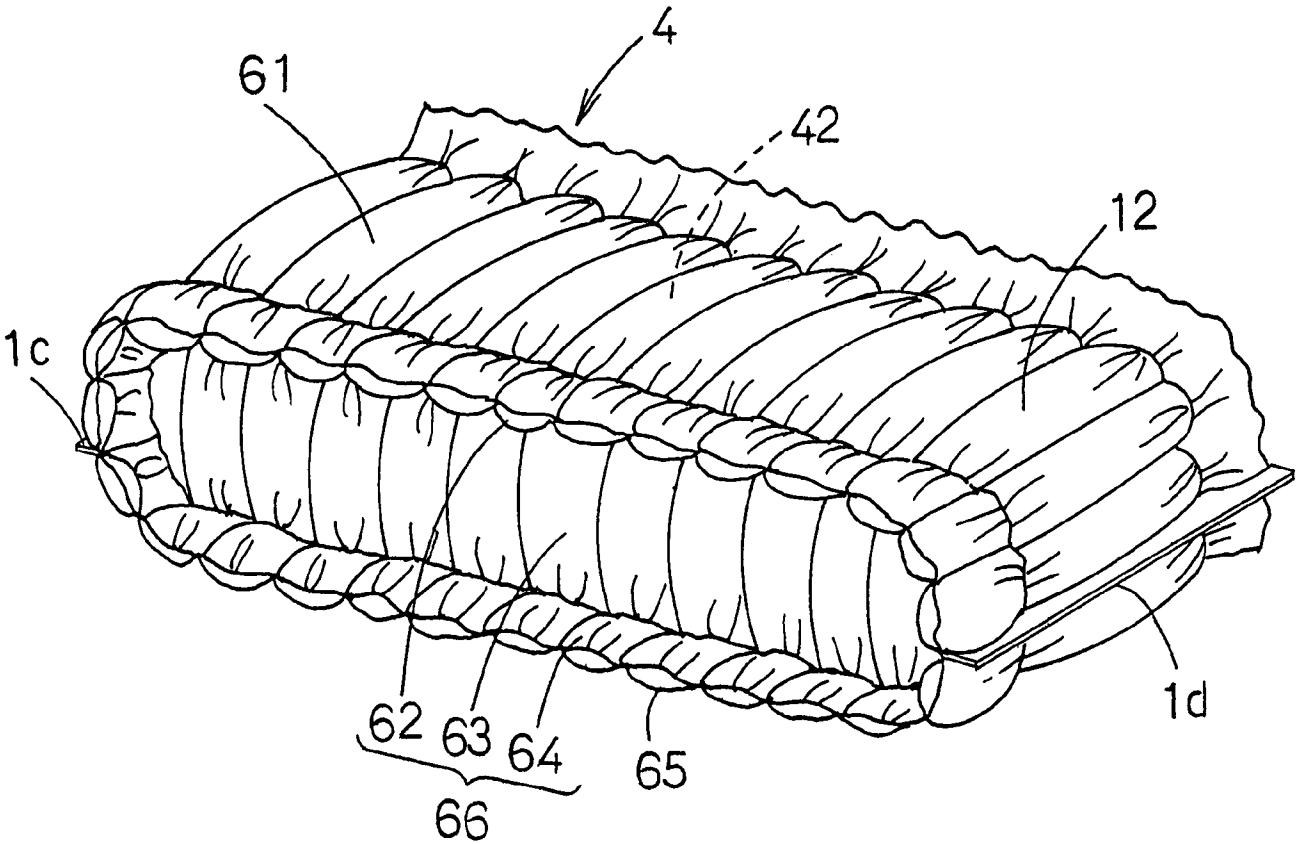
FIG. 5 is a perspective view representing a cubiform cushioning medium in accordance with a second embodiment of the present invention.

Next, an inflated cubiform cushioning medium 4 as illustrated in FIGS. 5 and 8 shall be produced by introducing air into the cells 12 of the cubiform cushioning medium 4 (before inflated) thus formed as set forth.

Introduction of air into the cells 12 inflates the inflated first, third and fifth faces 61, 63, 65 surrounding an opening 42, as shown in FIG. 8. The article A can be received in the opening 42, while contacting the first, third and fifth faces 61, 63, 65.

When inflated, part of the first face 61(outside from the second crease line 52 in FIG. 8), the second face 62, the fourth face 64 and part of the fifth face 65 (beneath the third crease line 53 in FIG. 8) are located outward of the corner of the article A. For convenience's sake, this part is named shock absorber 70, which will be described.

Referring to conventional cushioning mediums, especially when the article to be protected falls from one of its corners to the ground, the cells around the corner of the article are likely to receive pressure or impact, causing burst or flow of air in the cells, indeed as in the case of a direct landing of the article, leaving damage on it.

In this connection, said shock absorber 70 as provided in the cubiform cushioning medium 4 of this embodiment, in which the cells 12 are arranged two-ply, makes it hard for the cells in this area to burst or flow of air by a strong impact, thereby providing the article A with sufficient protection.

Therefore, this provision is very effective for articles such as damageable glass bottles for liquor as indicated in the first embodiment, and in particular, can give more effective protection to relatively heavy articles such as VCRs.

The inventor of the present invention made a test by dropping a corrugated box containing a VCR of 4 kg in the opening 42 of the cubiform cushioning medium 4 in the second embodiment shown in FIG. 8 from the height of 75 cm (in a fashion of dropping corner fast). There was no damage found with the cells 12 of the cubiform cushioning medium 4 or the VCR.

For the purpose of comparison, another test was conducted under the same condition for dropping a corrugated box containing a VCR in the opening of the cushioning medium without excessive cells (shock absorber) at the bottom portion thereof like a conventional cushioning medium. As a result, it was found that the cells had torn and the VCR suffered damage as well.

Accordingly, the cubiform cushioning medium 4 in accordance with the second embodiment is also capable of sufficiently protecting a relatively heavy article A.

The cubiform cushioning medium 4 in the second embodiment may also be modified in different manners as in the first embodiment.

With the cubiform cushioning medium 4 in the second embodiment, an element like a cover 15 as showing in FIGS. 1 and 4 may be also provided for closing the opening portion 41.

It may be applied for the first and second faces 61, 62 and the fourth and fifth faces 64, 65 to overlap widely by separating the first and second crease lines 51, 52 with a wide breadth from each other. In this case, the opening 42 will be defined in the inner area of the overlapped faces.

However, the cells 12 positioned in the shock absorber 70 are configured in one ply. This specific arrangement is more adaptable to the case in which the protection of the lateral faces where the cells 12 are in a two-ply configuration is regarded more important than the protection for the corner fast dropping or falling.

Figure 9:
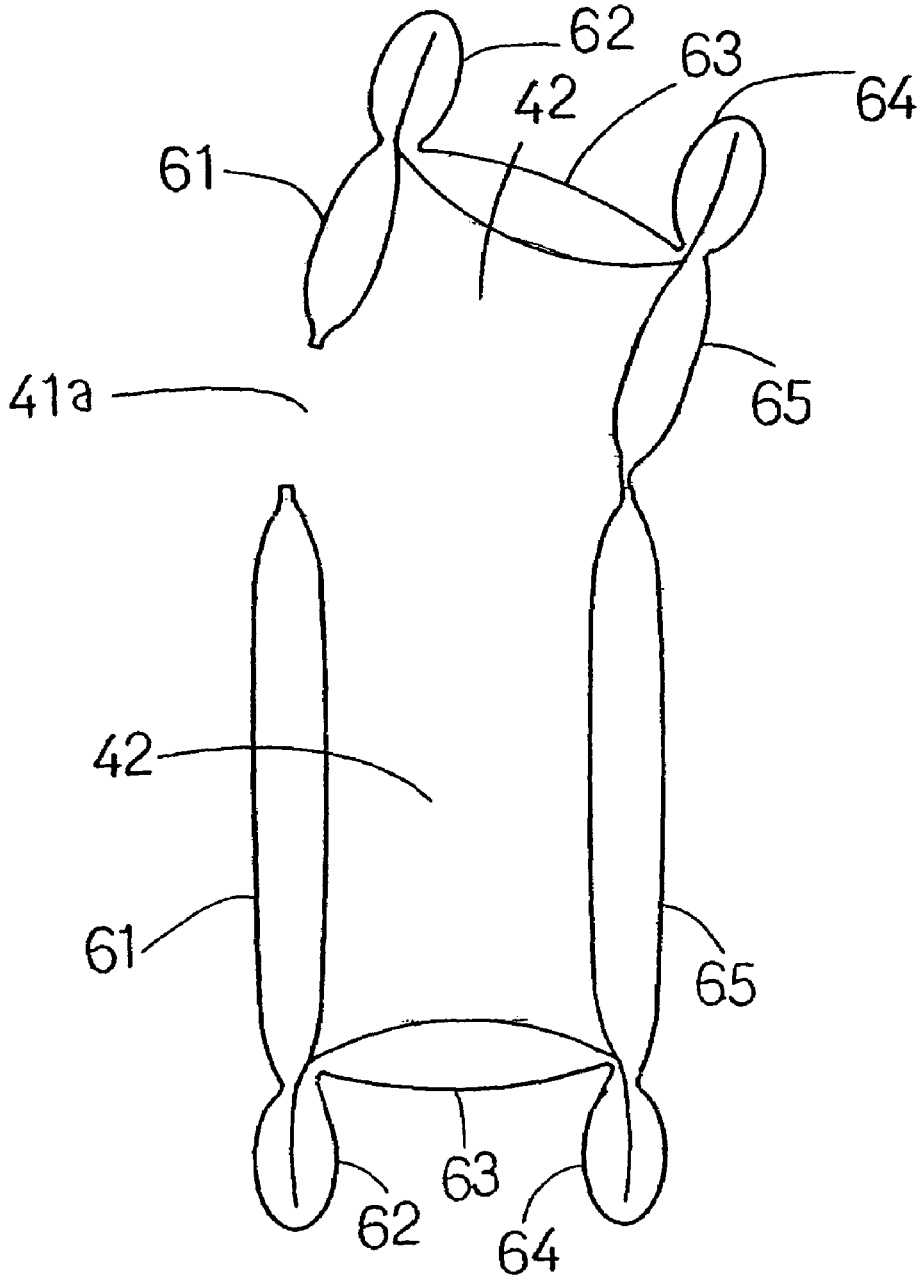
FIG. 9 is a cross sectional view representing a cubiform cushioning medium in accordance with other embodiment of the present invention.

As illustrated in FIG. 9, an arrangement is available such that two cubiform cushioning mediums 4 as shown in FIGS. 5 and 8 are connected with the opening portion 41 lying face to face. In this event, whole wrapping of the article A can be performed to secure sufficient protection by disposing an opening portion 41*a*, for example, at the side of the lateral cushioning face 61.

The effects of the cubiform cushioning mediums in accordance with the present invention are as follows.

In accordance with the first aspect of the present invention, the bottom cushioning portion is folded upward to the top of the lateral cushioning faces, whereby cushioning effect at the bottom by air inside the cells along with the bottom cushioning portion may be more effective than conventional cushioning mediums achieved only by air inside the cells so as to protect an article to be protected.

In accordance with the second aspect of the present invention, in addition to the above-mentioned effect, the bottom cushioning portion folded by forming the crease seals may protect the article effectively.

In accordance with the third aspect of the present invention, in addition to the effect of said first aspect of the present invention, the cushioning effect by the overlapped portion of part of the bottom cushioning portion and the lateral cushioning face by way of sealing together may protect the article effectively.

In accordance with the fourth aspect of the present invention, in addition to the effect of said second or third aspect of the present invention, the arrangement of the lateral cushioning faces in a manner of encircling the opening may protect the article in the 360-degree directions.

In accordance with the fifth aspect of the present invention, in addition to the effects of said second to fourth aspects of the invention, inasmuch as the air inlet is formed in each of the cells, one deflated cell will not affect other cells, so that the cushioning effect may be preserved. Furthermore, crease seals are partially sealed so as to allow air to flow in the cells freely, and determine the configuration of the bottom cushioning portion.

In accordance with the sixth or seventh aspect of the present invention, uncomplicated forming of the cubiform cushioning medium may be provided by folding a planar cushioning medium and the resultant cubiform cushioning medium may provide superior cushioning effect compared to conventional cushioning mediums.

What is claimed is:

1. A cubiform cushioning medium for containing an article comprising:

a planar cushioning medium having a plurality of independent cells formed by partially sealing two opposite non-breathable flexible resin sheets together, said cells encapsulating air in order to cause a cushioning effect, wherein said planar cushioning medium and each of the independent cells formed therein are folded in at least three places, the resulting structure having two lateral cushioning faces which are substantially equal in size with a bottom cushioning portion formed between the two lateral cushioning faces, each of the independent cells extending along one of the two lateral cushion faces, across the bottom cushion portion, and along the second of the two lateral cushioning faces, the bottom cushioning portion having at least one inward facing crease seal, wherein an opening for inserting an article to be protected is formed between ends of the two lateral cushioning faces opposite to the bottom cushioning portion, and wherein the ends of the cubiform cushioning medium opposite to the bottom cushioning portion are bonded, thereby enclosing the article to be protected inside the cubiform cushioning medium.

2. The cubiform cushioning medium as defined in claim 1, wherein the bottom cushioning portion is arranged to connect bottom ends of the lateral cushioning faces, and is folded to form a single inward facing crease seal, and wherein the resulting structure with the two lateral cushioning faces and the bottom cushioning portion having the single inward facing crease seal has a shape of an inverted M when viewed from a direction perpendicular to the lateral cushioning faces.

3. The cubiform cushioning medium as defined in claim 1, wherein the bottom cushioning portion is arranged to close the bottom end of the lateral cushioning faces by folding parts of said bottom cushioning portion along the two lateral cushioning faces, and by bonding the parts of the bottom cushioning portion to the lateral cushioning faces, whereby the lateral cushioning faces are bonded together to form two crease seals at desired lengths above bottom ends of the lateral cushioning faces, wherein the resulting structure with the two lateral cushioning faces and the bottom cushioning portion having the two crease seals is substantially H-shaped when viewed from a direction perpendicular to the lateral cushioning faces.

4. The cubiform cushioning medium as defined in claim 2, wherein after folding the planar cushioning medium, right and left sides of the lateral cushioning faces overlap each other and are bonded together.

5. The cubiform cushioning medium as defined in claim 2, wherein each of the cells is provided with an air inlet for introducing air into each of the cells, and said crease seals are formed by partially bonding each of the cells, the partial bonding allowing air to flow in within each of the cells.

6. The cubiform cushioning medium as defined in claim 3, wherein after folding the planar cushioning medium, right and left sides of the lateral cushioning faces overlap each other and are bonded together.

7. The cubiform cushioning medium as defined in claim 3, wherein each of the cells is provided with an air inlet for introducing air into each of the cells, and said crease seals are formed by partially bonding each of the cells, the partial bonding allowing air to flow in within each of the cells.

8. The cubiform cushioning medium as defined in claim 4, wherein each of the cells is provided with an air inlet for introducing air into each of the cells, and said crease seals are formed by partially bonding each of the cells, the partial bonding allowing air to flow in within each of the cells.

9. A cub cubiform cushioning medium for containing at least one end of an article, comprising:

a planar cushioning medium having a plurality of independent cells formed by partially sealing two opposite non-breathable flexible resin sheets together, said cells encapsulating air in order to cause a cushioning effect, wherein said planar cushioning medium and each of the independent cells formed therein are folded in at least three places, the resulting structure having two opposite lateral cushioning faces which are substantially equal in size with a bottom cushioning portion formed between the two lateral cushioning faces, each of the independent cells extending along one of the two lateral cushion faces, across the bottom cushion portion, and along the second of the two lateral cushioning faces, the bottom cushioning portion having at least one inward facing crease seal, wherein an opening for inserting at least one end of an article to be protected is formed between ends of the two lateral cushioning faces opposite to the bottom cushioning portion.

10. The cubiform cushioning medium as defined in claim 9, the bottom cushioning portion being arranged to connect bottom ends of the lateral cushioning faces, and being folded along the crease seals formed therein.

11. The cubiform cushioning medium as defined in claim 9, wherein each of the cells is provided with an air inlet for introducing air into each of the cells, and said crease seals are formed by partially bonding each of the cells, the partial bonding allowing air to flow within each of the cells.

12. The cubiform cushioning medium as defined in claim 9, wherein after folding the planar cushioning medium, right and left sides of the lateral cushioning faces overlap each other and are bonded together.

13. The cubiform cushioning medium as defined in claim 9, wherein said planar cushioning medium is folded in four places, the resulting structure having two opposite lateral cushioning faces with a bottom cushioning formed between the two lateral cushioning faces, the bottom cushioning portion having two inward facing crease seals.

14. A cubiform cushioning medium for containing an article comprising:

a planar cushioning medium having a plurality of independent cells formed by partially sealing two opposite non-breathable flexible resin sheets together, said cells encapsulating air in order to cause a cushioning, wherein said planar cushioning medium is folded in at least three places, the resulting structure having two lateral cushioning faces with a bottom cushioning portion formed between the two lateral cushioning faces, the bottom cushioning portion having at least one inward facing crease seal, wherein an opening for inserting an article to be protected is formed between ends of the two lateral cushioning faces opposite to the bottom cushioning portion, and wherein the ends of the cubiform cushioning medium opposite to the bottom cushioning portion are bonded, thereby enclosing the article to be protected inside the cubiform cushioning medium, wherein the bottom cushioning portion is arranged to close the bottom end of the lateral cushioning faces by folding parts of said bottom cushioning portion along the two lateral cushioning faces, and by bonding the parts of the bottom cushioning portion to the lateral cushioning faces, whereby the lateral cushioning faces are bonded together to form two crease seals at desired lengths above bottom ends of the lateral cushioning faces, wherein the resulting structure with the two lateral cushioning faces and the bottom cushioning portion having the two crease seals is substantially H-shaped when viewed from a direction perpendicular to the lateral cushioning faces.

* * * * *